US009573789B2

(12) United States Patent
Appana

(10) Patent No.: US 9,573,789 B2
(45) Date of Patent: Feb. 21, 2017

(54) ELEVATOR LOAD DETECTION SYSTEM AND METHOD

(71) Applicant: ThyssenKrupp Elevator Corporation, Atlanta, GA (US)

(72) Inventor: Amarnauth Eric Appana, Jamaica, NY (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 408 days.

(21) Appl. No.: 14/227,137

(22) Filed: Mar. 27, 2014

(65) Prior Publication Data

US 2015/0274485 A1 Oct. 1, 2015

(51) Int. Cl.
*B66B 1/34* (2006.01)
*B66B 1/24* (2006.01)

(52) U.S. Cl.
CPC ..... *B66B 1/2408* (2013.01); *B66B 1/3476* (2013.01); *B66B 2201/222* (2013.01)

(58) Field of Classification Search
CPC . B66B 1/2408; B66B 1/3476; B66B 2201/222
USPC 187/247, 281, 380–388, 391, 393; 318/430, 432, 434
See application file for complete search history.

(56) References Cited

U.S. PATENT DOCUMENTS 2,779,439 A 1/1957 Borden
3,891,064 A 6/1975 Clark
4,503,937 A 3/1985 Cervenec et al.
4,623,041 A * 11/1986 Horbrugger ..... B66B 1/3476 187/392
4,708,224 A 11/1987 Schrooder
4,773,508 A 9/1988 Mine et al.
4,838,384 A 6/1989 Thangavelu
5,435,416 A * 7/1995 Siikonen ..... B66B 1/3484 187/392
5,490,580 A * 2/1996 Powell ..... B66B 1/2408 187/281

(Continued)

FOREIGN PATENT DOCUMENTS

DE 10056284 5/2002
GB 545150 5/1942
WO WO 2010/059139 5/2010

OTHER PUBLICATIONS

Koehler, J., et al., "An AI-Based Approach to Destination Control in Elevators," AI magazine, vol. 23, No. 3, Fall 2002, pp. 59-78.

*Primary Examiner* — Anthony Salata
(74) *Attorney, Agent, or Firm* — Frost Brown Todd LLC

(57) ABSTRACT

An elevator car control system and method of operation determines occupancy weight based upon motor load. Information on motor load is collected during ascent and descent with loaded and unloaded elevator cars and used to create estimates of occupancy weight based for the full range of motor loads throughout travel within the hoistway. Once the estimates are available the approximate occupancy weight can be determined after each floor stop and appropriate action can be taken. One action is Load Bypass which prevents the elevator car from stopping to load more passengers until occupancy weight decreases. Another action is Nuisance Detection which clears all internal floor calls when occupancy weight indicates no passengers are present. Another action is Load Dispatch which prioritizes a floor for pickup based on demand.

13 Claims, 6 Drawing Sheets

(56) References Cited

U.S. PATENT DOCUMENTS

| | | | | |
|---|---|---|---|---|
| 5,531,294 | A * | 7/1996 | Burton | B66B 1/28 187/292 |
| 5,852,264 | A | 12/1998 | Muller | |
| 5,859,373 | A * | 1/1999 | Munzebrock | B66C 13/16 73/862.193 |
| 5,883,344 | A | 3/1999 | Colby et al. | |
| 5,986,357 | A | 11/1999 | Myron et al. | |
| 6,043,999 | A | 3/2000 | Ehrenberg et al. | |
| 7,387,191 | B2 * | 6/2008 | Kostka | B66B 1/20 187/247 |
| 7,588,125 | B2 * | 9/2009 | Ueda | B66B 1/285 187/293 |
| 7,954,604 | B2 * | 6/2011 | Mishima | B66B 1/30 187/293 |
| 7,975,808 | B2 | 7/2011 | Smith et al. | |
| 8,376,090 | B2 * | 2/2013 | Kostka | B66B 5/021 187/281 |

* cited by examiner

ELEVATOR LOAD DETECTION SYSTEM AND METHOD

BACKGROUND

In the field of elevators, it is useful to know the occupancy weight of an elevator car during operation in order to optimize control of the elevator car. Some current load weighing or detection methods use sensors that require recurring manual calibration to maintain accuracy throughout the course of use. While a variety of elevator load weighing or detection systems have been made and used, it is believed that no one prior to the inventors has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings like reference numerals identify the same elements.

Figure 1:
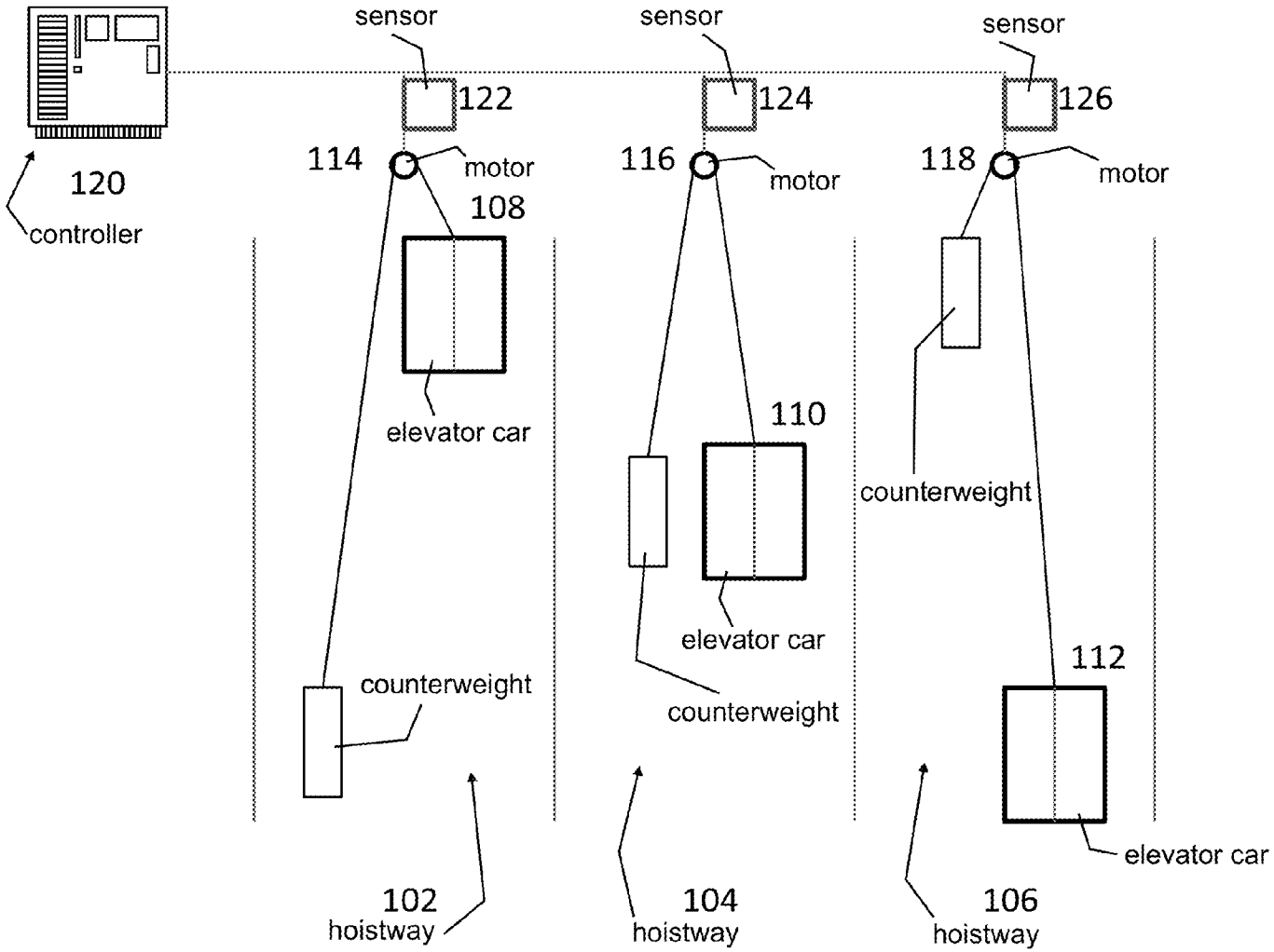
FIG. 1 illustrates an example of an elevator car system having multiple elevators, where the system determines elevator load through the drive.

The drawings are not intended to be limiting in any way, and it is contemplated that different versions may be carried out in other ways, including those not necessarily depicted in the drawings. The accompanying drawings illustrate several aspects of the present invention, and with the description serve to explain the principles of the invention. The present invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 illustrates an example of an elevator car system having multiple elevators, where the system determines elevator load through the drive. Three elevator cars (108, 110, 112) are installed within three different hoistways (102, 104, 106). A first elevator car (108) is shown in a fully ascended position, a second elevator car (110) is shown moving between a fully ascended and fully descended position, and a third elevator car (112) is shown in a fully descended position. Motors (114, 116, 118) are operable to drive the respective elevator cars (108, 110, 112) in an ascending or descending direction. A controller (120) is configured to communicate with the elevator cars (108, 110, 112) such that it can send and receive information and commands from occupants or others, e.g. maintenance technicians or a separate control room or system. The controller (120) is further configured to communicate with the motors (114, 116, 118) such that it can cause them to the drive elevator cars (108, 110, 112). Sensors (122, 124, 126) are attached to each of the motors (114, 116, 118) and the controller (120) and are configured to signal the current electrical load upon the motors (114, 116, 118) and report this information to the controller (120). In some versions controller (120) reads a motor or drive current reading from the motor via an analog signal or via serial communication from the motor. For instance in the present example sensors (122, 124, 126) represent a 0-10 Vdc signaling system, where a variable reading between 0 and 10 is provided with a reading of 10 corresponding to a motor output of 100% and a reading of 0 corresponding to a motor output of 0%.

FIG. 1 should not be seen as limiting the configurations that an elevator car system using the load detection system described herein could have. By way of example and not limitation, some versions can have more than one controller, one elevator car instead of multiple elevator cars, more than one sensor for each motor, a sensor built into the motor instead of attached in line between the motor and controller, or other configurations which would apparent to one of ordinary skill in the art in view of the teachings herein.

Figure 2:
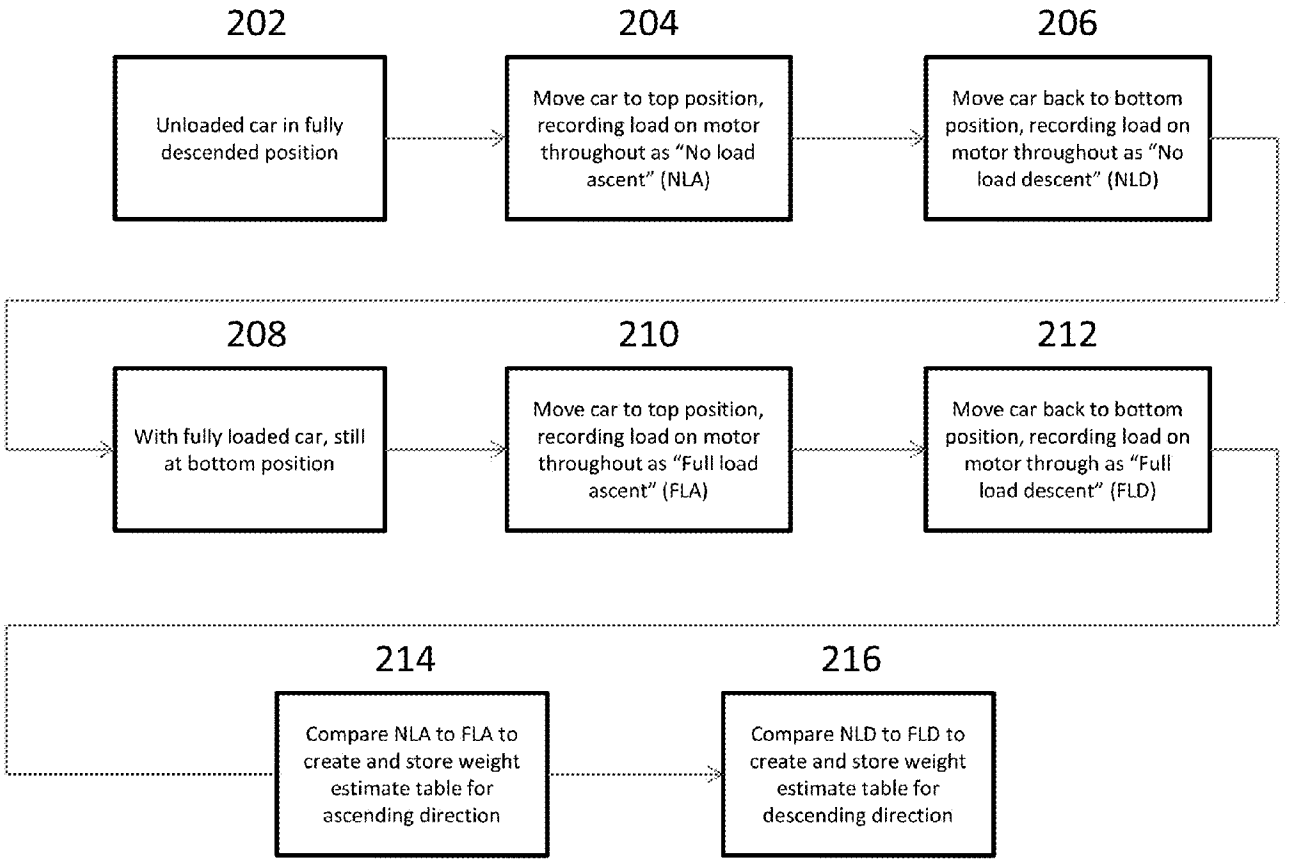
FIG. 2 shows an example block diagram of a calibration operation for the load determining features of the elevator car system of FIG. 1.

FIG. 2 shows an example block diagram of a calibration operation for the load determining features of the elevator car system of FIG. 1. The set of steps of FIG. 2 create a set of occupancy weight estimations based upon motor load. In some versions these steps are performed by elevator controller (120). Within this example, the controller (120) would be placed into a calibration mode which would cause the set of steps to be performed for each elevator car (108, 110, 112). Of course where the specifications of all the elevator cars are the same, one elevator car could be calibrated according to the steps of FIG. 2 and then that calibration applied to the other elevator cars in the system. When placed into calibration mode, an elevator car (108) would be in an unloaded state and would move to the fully descended position (202). Once this step is complete, the elevator car (108) would ascend to the top of the hoistway (102), allowing the sensor (122) to measure the electrical load drawn by the motor (114), and allowing the controller (120) to record the measured load as e.g. "No Load Ascent" ("NLA") (204). Once the car (108) reaches the top of the hoistway (102), it will descend to the bottom of the hoistway (102), allowing the sensor (122) to measure the electrical load drawn by the motor (114), and allowing the controller (120) to record the measured load as e.g. "No Load Descent" ("NLD") (206). Similar steps would be repeated for elevator cars (110, 112).

Once load measurement of the unloaded ascent (204) and unloaded descent (206) is complete, the elevator car (108) would be placed into a fully loaded state and would still be in a fully descended position (208) from the previous step. The elevator car (108) would ascend to the top of the hoistway (102), allowing the sensor (122) to measure the electrical load drawn by the motor (114), and allowing the controller (120) to record the measured load as e.g. "Full Load Ascent" ("FLA") (210). Once the car (108) reaches the top of the hoistway (102), it will descend to the bottom of the hoistway (102), allowing the sensor (122) to measure the electrical load drawn by the motor (114), and allowing the controller (120) to record the measured load as e.g. "Full Load Descent" ("FLD") (212). Similar steps would be repeated for elevator cars (110, 112). An example of a data structure which could be representative of the recorded values for NLA, NLD, FLA and FLD is set forth below in Table 1.

TABLE 1

Java style pseudo code representation of a data structure storing values for NLA, NLD, FLA, and FLD which is created during the calibration steps of FIG. 2.

```
Object loadValues{
int NLA = 0;
int FLA = 10;
int NLD = 10;
int FLD = 0;
}
```

After recording the values for NLA (204), NLD (206), FLA (210) and FLD (212), a load estimate table is created. The sets of ascending and descending values are compared to create a table which correlates a plurality of motor load values to a plurality of estimated weights for both the ascending and descending directions of travel through the hoistway in steps (214, 216). An example of an algorithm which could be used to create such a table is set forth below in Table 2.

TABLE 2

Java style pseudo code representation of an example algorithm for creating a weight estimate table for the ascending and descending direction.

```
//Method receives an object, loadValues, which contains a plurality of
values representing the electrical load being drawn by the motor, recorded
in FIG. 2.
int NLA = loadValues.get("NLA");
int FLA = loadValues.get("FLA");
int NLD = loadValues.get("NLD");
int FLD = loadValues.get("FLD");
//this could be a static value representing the manufacturers tested
maximum occupancy weight for an elevator car
int maxweight = 1600;
int precision = 10;
//calculate the difference in weight between each row of the table
int weightper = maxweight/precision;
array weightTableAscend = new array( );
array weightTableDescend = new array( );
//calculate difference in load between each row of the table
var ascendingstep = (FLA−NLA)/precision;
//set starting points for load and weight
var loadascend=NLA;
var ascendweight=0;
//calculate weight estimate for ascending direction
for(i=1;i<=precision;i++){
    loadascend=loadascend+ascendingstep;
    ascendweight=ascendweight+weightper;
    weightTableAscend.add(loadascend,ascendweight);
    }
//calculate difference in load between each row of the table
var descendingstep = (NLD−FLD)/precision;
//set starting points for load and weight
var loaddescend = NLD;
var descendweight=0;
//calculate weight estimate for descending direction
for(i=1;i<=precision;i++){
    loaddescend = loaddescend − descendingstep;
    descendweight= descendweight+weightper;
    weightTableDescend.add(loaddescend,descendweight);
}
```

To illustrate how an algorithm such as shown in Table 2 could operate in practice, to create a weight estimate table, the algorithm, e.g. that shown in Table 2, would be initiated and given the data structure shown in Table 1. Additionally, a maximum weight will be provided which could be the manufacturers maximum allowed weight for the elevator car. Also, a precision value will be provided, which determines the level of precision at which estimations are made. Next, there is a first "for loop" in algorithm 2 that creates the weight estimate table for the ascending direction. This loop will execute a number of times corresponding to the provided precision value, where each time the loop executes a data pair is created consisting of a load and corresponding estimated weight for an ascending elevator. When the loop is finished executing, the result will be a weight estimate table for the ascending direction (214). Table 3 below shows an example of the calculations made during loop executions, while Table 4 below shows the complete set of resulting data.

TABLE 3

Java style pseudo code representation of calculations made during the ascending value calculation loop of Table 2.

```
NLA = 0;
FLA = 10;
maxweight = 1600
precision = 10
weightper (maxweight/precision) = 160
ascendingstep ((FLA−NLA)/precision) = (10−0)/10 = 1
loadascend (NLA) = 0;
ascendweight = 0;
loop 1:
loadascend (loadascend + ascendingstep) = 0 + 1 = 1
ascendweight (ascendweight + weightper) = 0 + 160 = 160
loop 2:
loadascend (loadascend + ascendingstep) = 1 + 1 = 2
ascendweight (ascendweight + weightper) = 160 + 160 = 320
loop 3:
loadascend (loadascend + ascendingstep) = 2 + 1 = 3
ascendweight (ascendweight + weightper) = 320 + 160 = 480
<similar steps omitted>
loop 9:
loadascend (loadascend + ascendingstep) = 8 + 1 = 9
ascendweight (ascendweight + weightper) = 1280 + 160 = 1440
loop 10:
loadascend (loadascend + ascendingstep) = 9 + 1 = 10
ascendweight (ascendweight + weightper) = 1440 + 160 = 1600
<loop ends>
```

TABLE 4

Ascending weight estimate table created by the algorithm shown in Table 2 and calculations shown in Table 3.
Ascending Weight Estimate Table

| Load | Occupancy Weight |
|---|---|
| 1 | 160 lbs |
| 2 | 320 lbs |
| 3 | 480 lbs |
| 4 | 640 lbs |
| 5 | 800 lbs |
| 6 | 960 lbs |
| 7 | 1120 lbs |
| 8 | 1280 lbs |
| 9 | 1440 lbs |
| 10 | 1600 lbs |

Creating the weight estimate table for the descending direction (216) is also shown in the example algorithm of Table 2 above. The logic is similar to that executed when creating the ascending table, but differs in that a lower motor load on descent indicates a heavier occupancy load, since the occupancy weight drives the elevator car down and reduces load on the motor. Table 5 below shows an example of the calculations made during loop executions, while Table 6 below shows the complete set of resulting data.

TABLE 5

Java style pseudo code representation of calculations made during the descending value calculation loop of Table 2.

```
NLD = 10;
FLD = 0;
maxweight = 1600
precision = 10
weightper (maxweight/precision) = 160
descendingstep ((NLD−FLD)/precision) = (10−0)/10 = 1
loaddescend (NLD) = 10;
descendweight = 0;
loop 1:
loaddescend (loaddescend − descendingstep) = 10 − 1 = 9
descendweight (descendweight + weightper) = 0 + 160 = 160
loop 2:
loaddescend (loaddescend − descendingstep) = 9 − 1 = 8
descendweight (descendweight + weightper) = 160 + 160 = 320
loop 3:
loaddescend (loaddescend − descendingstep) = 8 − 1 = 7
descendweight (descendweight + weightper) = 320 + 160 = 480
<similar steps omitted>
loop 9:
loaddescend (loaddescend − descendingstep) = 2 − 1 = 1
descendweight (descendweight + weightper) = 1280 + 160 = 1440
loop 10:
loaddescend (loaddescend − descendingstep) = 1 − 1 = 0
descendweight (descendweight + weightper) = 1440 + 160 = 1600
<loop ends>
```

TABLE 6

Descending weight estimate table created by the algorithm shown in Table 2 and calculations shown in Table 5.
Descending Weight Estimate Table

| Load | Occupancy Weight |
|---|---|
| 9 | 160 lbs |
| 8 | 320 lbs |
| 7 | 480 lbs |
| 6 | 640 lbs |
| 5 | 800 lbs |
| 4 | 960 lbs |
| 3 | 1120 lbs |
| 2 | 1280 lbs |
| 1 | 1440 lbs |
| 0 | 1600 lbs |

The example above is by way of illustration only and a person of ordinary skill in the art could devise a number of alternate embodiments. For example, the loadValues object which stores the load values from the calibration steps (204, 206, 210, 212) could contain an array of values for each of the NLA, NLD, FLA and FLD variables rather than a single value for each. An array of values captured throughout the journey from fully descended to fully ascended could be used to create a table or profile of weight estimations by travel direction and position within the hoistway based on observed motor load. Furthermore, an array of values corresponding to points along a hoistway could also be used to create multiple estimation tables, with each table covering a certain part of the hoistway, allowing for even greater accuracy in situations where motor load varies, e.g. in a non-linear fashion, throughout certain parts of the hoistway compared to other parts of the hoistway.

The layout and contents of the weight estimation table could also vary. For example, the motor load could be recorded to the table as a measurement of wattage, horsepower, joules, or any other measurement which captures or approximates the amount of load on the motor. Further, the load could be recorded to the table in abstracted form, such as percentage of current motor output compared to the motors maximum operating limits. Similarly, the weight estimate could be recorded to the weight estimate table as a pound, kilogram, or abstracted number such as a percentage of current weight compared to the maximum tolerable weight of the elevator car, or any other measurement which captures or approximates the estimated occupancy weight.

The algorithm in Table 2 is also only a single example of many possible algorithms which could create a weight estimate table based upon motor load. For example, the algorithm in Table 2 creates a set of estimates for a motor whose load approximates occupancy weight in a linear fashion. An alternative embodiment could instead use an algorithm which creates a set of non-linear estimates which could result in better accuracy for a motor with non-linear relation between power consumption and occupancy weight. Yet another embodiment of the algorithm of Table 2 could accept other variables in addition to load, for example, a variable representing a non-optimal status of the elevator cable which might result in additional load on the motor independent of occupancy weight. By accepting and factoring in the non-optimal condition the accuracy of weight estimates could be maintained until the issue is resolved.

Figure 3:
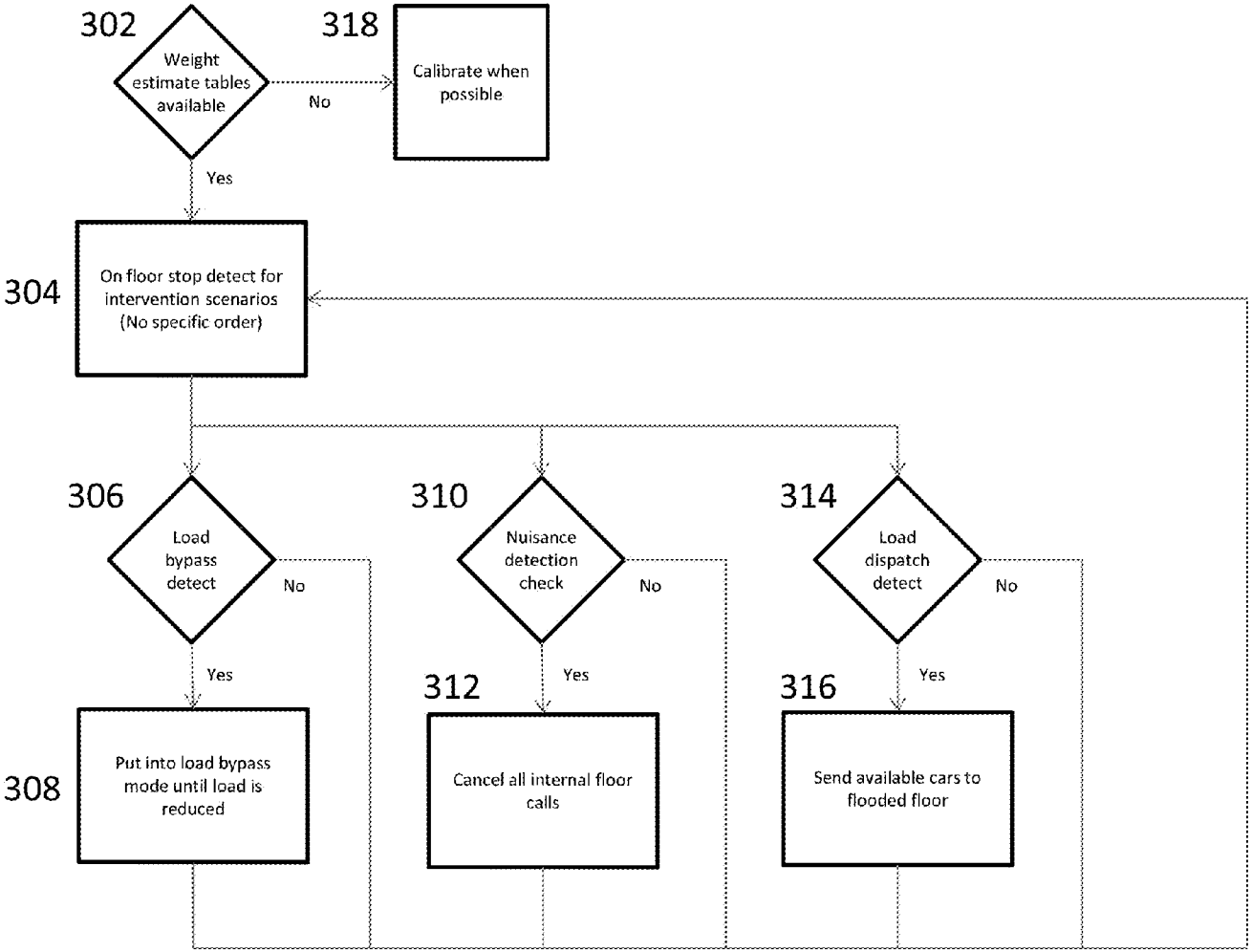
FIG. 3 shows an example of a block diagram of example modules or mode of operation for use with the elevator car system of FIG. 1.

Once the example steps of FIG. 2 are completed, the weight estimate tables for the ascending and descending direction are made available to the controller (120). FIG. 3 depicts an example of a block diagram of modules or modes of operation for use with the elevator car system of FIG. 1. For instance, FIG. 3 shows example steps which could be performed using the weight estimates tables described above. When the weight estimate tables are available (302), a number of intervention scenarios can be detected for at each floor stop (304), when it is likely that passengers have loaded or unloaded and occupancy weight has changed. If weight estimate tables are not available, the calibration steps of FIG. 2 should be performed when possible (318).

At step (304), one or more intervention scenarios can be detected after each floor stop, and if triggered can change the operating characteristics of one or more elevator cars (108, 110, 112). FIG. 3 shows these scenarios as being tested for in parallel as an example only, as they could occur in series or in any other order. One intervention scenario which can be detected for is Load Bypass (306). Load Bypass occurs when a weight estimate table indicates that an elevator car is at or near full occupancy. An elevator car in Load Bypass mode (308) will ignore external floor calls and instead optimize internal floor calls so that passengers may exit and reduce occupancy, which could result in Load Bypass mode being disabled so that additional passengers can be accepted for that elevator car. Other example intervention scenarios can include Nuisance Detection (310)—where internal floor calls are canceled (312)—and Load Dispatch Detection (314)—where available cars are sent to a flooded or heavy traffic floor (316). These intervention modes or scenarios will be described further below.

Figure 4:
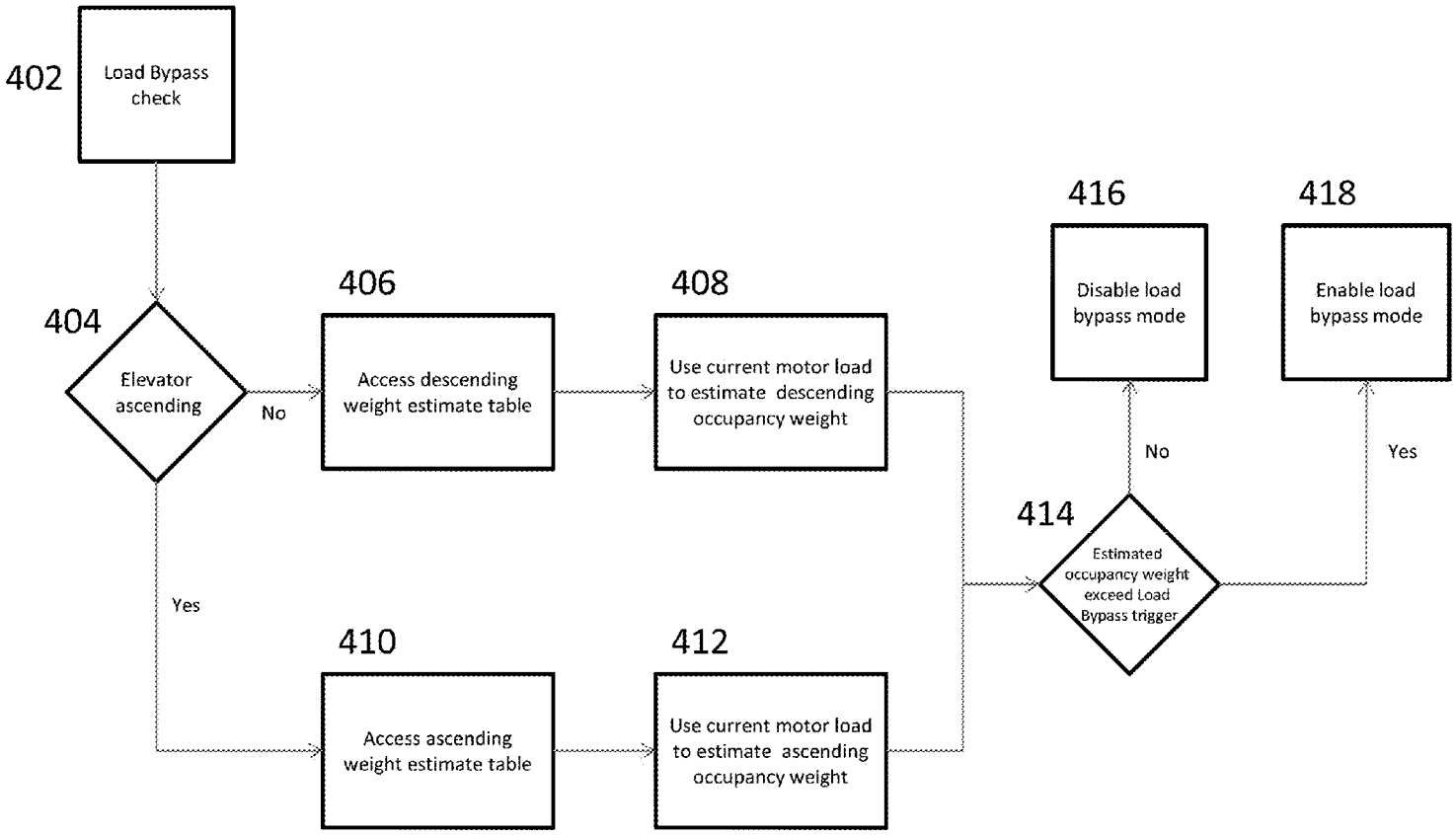
FIG. 4 illustrates an example block diagram of steps to perform the Load Bypass module or operation of FIG. 3.

In order to better understand the Load Bypass intervention scenario, FIG. 4 illustrates an example of a set of steps which can be performed in order to test for and execute Load Bypass mode. Once a check for Load Bypass detection is requested (402) the direction that the elevator is traveling will be determined. If the elevator is ascending (404) the ascending weight estimate table will be accessed (410). The elevator's current motor load is compared (412) to the ascending weight estimate table (410). For example, using the ascending weight estimate table shown in Table 4, if the current motor load is reported as 9 the estimated occupancy weight would be 1440 lbs. Once a weight estimate has been determined, it is compared to a Load Bypass trigger weight (414) to determine if Load Bypass mode should be activated. If the Load Bypass trigger weight is exceeded by the weight estimate, Load Bypass mode is enabled (418) if it is not already. If the Load Bypass trigger weight is not exceeded by the weight estimate, Load Bypass mode is disabled (416) if it is not already.

For example, the Load Bypass trigger weight might be 1360 lbs, which would be 85% of the maximum allowed weight of 1600 lbs, representing a near full elevator car in this example. A weight estimate of 1440 lbs exceeds the Load Bypass trigger weight of 1360 lbs (414), therefore Load Bypass mode will be enabled (418), and the elevator will ignore external floor calls. At a next floor stop a passenger might disembark, and when the elevator continues its ascent the motor load might be reported as an 8. Again using Table 4, the weight estimate corresponding to a motor load of 8 is 1280 lbs. Since this value is under the Load Bypass trigger of 1360 lbs (414), Load Bypass mode will be disabled and the elevator car will once again answer external floor calls (416). While the discussion of FIG. 4 has focused on elevator cars moving in the ascending direction (404), the same functionality is also supported for descending elevator cars at steps (406, 408), with the descending weight estimate table shown in Table 6 being used instead of the ascending weight estimate table shown in Table 4.

Another intervention scenario included in the example of FIG. 3 is Nuisance Detection (310). Nuisance Detection occurs when a weight estimate table indicates that an elevator has no occupancy and has one or more internal floor calls. When Nuisance Detection is triggered, all internal floor calls are canceled (312) in order to prevent wasted floor stops.

Figure 5:
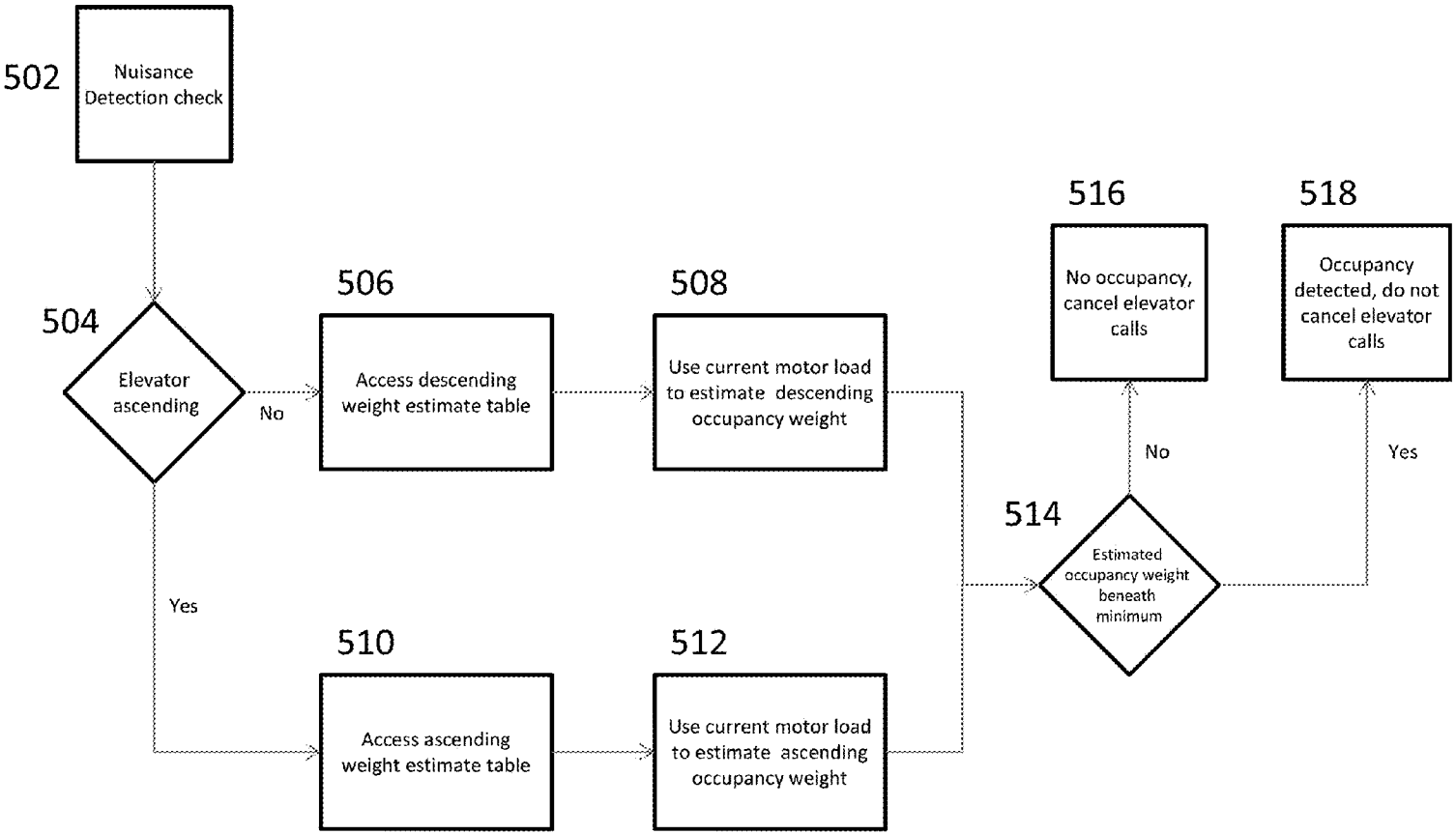
FIG. 5 illustrates an example block diagram of steps to perform a Nuisance Detection module or operation of FIG. 3.

FIG. 5 illustrates an example of a set of steps which can be performed to test for and execute Nuisance Detection. Once a Nuisance Detection check (502) is requested, it is determined whether the elevator car is ascending or descending (504). If the elevator car is ascending, the ascending weight estimate table is accessed and used (510), and the current motor load is compared to the table to determine a weight estimate for the current occupancy (512). If the elevator car is descending, the descending weight estimate table is accessed and used (506), and the current motor load is compared to the table to determine a weight estimate for the current occupancy (508). Once a weight estimate is determined, it is compared against a minimum occupancy weight for nuisance detection (514). If the estimated weight does not exceed the minimum occupancy weight, Nuisance Detection is triggered and any internal floor calls are canceled (516). If the estimated weight does exceed minimum occupancy weight, Nuisance Detection is not triggered and the elevator operates normally (518) by responding to any internal floor calls.

As an example of how the steps in FIG. 5 might operate, an elevator car (108) could stop at a floor and then leave the floor in the ascending direction, making a request for Nuisance Detection check (502) as it left. Since the car is ascending (504) the ascending weight estimate table will be used (510). If the motor load is reported as less than 1, the corresponding weight estimate from Table 4 would be less than 160 lbs (512). If the minimum occupancy weight is 160 lbs, the estimated weight would not exceed the minimum occupancy weight (514) and all internal floor calls would be canceled (516).

In some versions, the weight estimations are compared to the number of internal floor calls such that it can be determined if there is an excessive amount of internal floor calls compared to the number of passengers in the elevator car. For instance, if the weight detection indicates only 1-2 passengers are present in the elevator car, yet 7 upcoming floor stops (or internal floor calls) are registered, the Nuisance Detection module can be configured to cancel all the calls and request the passengers initiate new calls. Such a system could prevent the scenario of a bad actor depressing numerous floor buttons when exiting an elevator to thereby disrupt the trip of the passengers remaining on board. In view of the teachings herein, other ways to configure Nuisance Detection check (310) will be apparent to those of ordinary skill in the art.

Another intervention scenario included in the example of FIG. 3 is Load Dispatch (314). Load Dispatch detection occurs when a weight estimate table indicates that one or more elevators are taking on full occupancy from a single floor, possibly indicating that a large number of passengers are waiting to board from that floor. When Load Dispatch detection occurs, the identified floor can be prioritized for pickup (316). For example, by redirecting other available elevators in the system to that floor.

Figure 6:
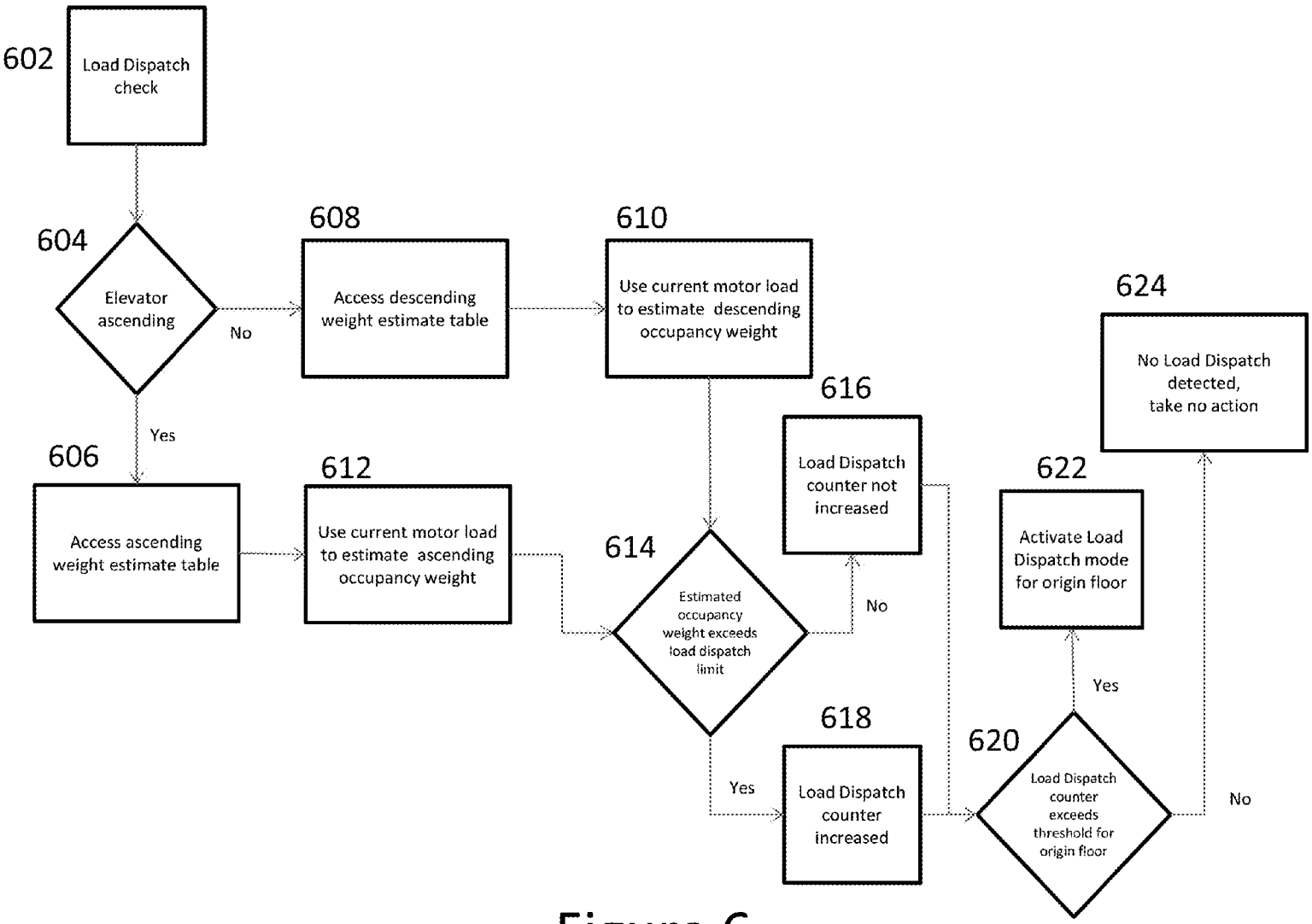
FIG. 6 illustrates an example block diagram of steps to perform a Load Dispatch module or operation of FIG. 3.

FIG. 6 illustrates an example of a set of steps which can be performed to test for and execute Load Dispatch detection (314). Once a Load Dispatch check is requested (602) it is determined whether the elevator car is ascending or descending (604). If the elevator car is ascending, the ascending weight estimate table is accessed (606) and used to determine the estimate weight corresponding to the motor load (612). If the elevator car is descending, the descending weight estimate table is accessed (608) and used to determine the estimate weight corresponding to the motor load (610). Once an estimate weight is determined, it is compared to a load dispatch weight limit (614). If load dispatch weight limit is not exceeded, the load dispatch counter is not increased (616). If load dispatch weight limit is exceeded, the load dispatch counter is increased (618). If the load dispatch counter exceeds a load dispatch threshold for a particular floor, Load Dispatch mode is enabled for that floor (622). If load dispatch counter does not exceed the load dispatch threshold, no action is taken (624).

As an example of how the steps in FIG. 6 might operate, if an elevator leaves floor A in the ascending direction with an estimate weight of 1440 lbs, and the load dispatch weight limit is 1400 lbs, the load dispatch counter will be increased for floor A from 0 to 1 (618). If the load dispatch threshold is 2 (620), the elevator cars continue to operate normally (624). If however two more cars leave from floor A, each exceeding the load dispatch weight limit, and each increasing the load dispatch counter for floor A (618), the load dispatch threshold will be exceeded and one or more elevator cars will be placed into Load Dispatch mode (622) where other available cars in the system will be directed to floor A to help alleviate the high or excess demand at floor A (sometimes this is referred to as a flooded floor scenario). Until the Load Dispatch mode expires, floor calls coming from floor A would be prioritized for pickup by one or more elevator cars. In some versions, the load dispatch counter is configured to reset or reduce in number by a desired unit after subsequent stops to floor A show that the estimated occupancy weight no longer exceeds the load dispatch limit at step (614).

As stated above, the intervention scenarios described herein can be used independently from one another in parallel or in series. In view of the teachings herein, other intervention scenarios and configurations for using the motor load as a means for detecting the weight within an elevator car will be apparent to those of ordinary skill in the art.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, measurements, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. An elevator system comprising:

(a) a plurality of elevator cars, each comprising:

(i) a motor, operable to move the elevator car, and (ii) a sensor attached to the motor to measure the electrical current drawn by the motor while moving the elevator car; and (b) an elevator controller configured to receive and use the electrical current measurement to estimate a present occupancy weight for each elevator car, and perform a first dependent action based upon the present occupancy weight, wherein the first dependent action comprises:

(i) comparing the present occupancy weight to a first weight threshold value, (ii) tracking each of the elevator cars having the present occupancy weight exceeding the first weight threshold value that also originate from a common origin floor, and (iii) placing one or more of the plurality of elevator cars into a first special operation mode when the number of tracked elevator cars exceeds a count threshold value for the common origin floor, wherein the first special operation mode directs one or more of the plurality of elevator cars to the common origin floor.

2. The elevator system of claim 1, wherein the elevator controller is further configured to perform a second dependent action based upon the present occupancy weight, wherein the second dependent action comprises:

(a) comparing the present occupancy weight to a second weight threshold value; and (b) placing the elevator car into a second special operation mode when the second weight threshold value is exceeded, wherein the second special operation mode prohibits the elevator car from picking up additional passengers until the present occupancy weight has decreased below the second weight threshold value.

3. The elevator system of claim 1, wherein the elevator controller is further configured to perform a second dependent action based upon the present occupancy weight, wherein the second dependent action comprises placing the elevator car into a second special operation mode when the present occupancy weight indicates no passengers are present, wherein the second special operation mode clears any internal floor calls for the elevator car.

4. A method for controlling one or more elevator cars comprising:

(a) causing the one or more elevator cars to move with no occupancy weight while measuring an electrical current drawn by a motor as a non-loaded data;

(b) causing the one or more elevator cars to move with full occupancy weight while measuring the electrical current drawn by the motor as a fully-loaded data;

(c) comparing the non-loaded data to the fully-loaded data and creating a set of estimate data comprising:

(i) a plurality of first data representing a motor load as the electrical current drawn by the motor, and (ii) a plurality of second data representing an occupancy weight within the one or more elevator cars at each corresponding first data;

(d) using the set of estimate data to determine the one or more elevator cars' current occupancy weight; and (e) providing instructions to the one or more elevator cars based upon the one or more elevator cars' current occupancy weight.

5. The method of claim 4 wherein the one or more elevator cars move in an ascending direction and create a set of estimate data for the ascending direction.

6. The method of claim 4 wherein the one or more elevator cars move in a descending direction and create a set of estimate data for the descending direction.

7. The method of claim 4 wherein the instructions provided comprise:

(a) comparing the one or more elevator cars' current occupancy weight to a weight threshold value; and (b) placing the one or more elevator cars into a load bypass mode when the threshold value is met or exceeded, wherein the load bypass mode restricts the one or more elevator cars from accepting additional passengers.

8. The method of claim 4 wherein the instructions provided comprise:

(a) comparing the one or more elevator cars' current occupancy weight to a weight threshold value; and (b) canceling all floor calls made within the one or more elevator cars when the threshold value is not met or exceeded.

9. The method of claim 4 wherein the instructions provided comprise:

(a) comparing the one or more elevator cars' current occupancy weight to a weight threshold value;

(b) incrementing a load dispatch count when the one or more elevator cars' current occupancy weight exceeds a threshold value; and (c) placing the one or more elevator cars into a load dispatch mode when the load dispatch count exceeds a load dispatch threshold for a common floor, wherein the load dispatch mode directs an available elevator car of the one or more elevator cars to the common floor.

10. The method of claim 4 wherein the instructions provided comprise:

(a) comparing the one or more elevator cars' current occupancy weight to a weight threshold value;

(b) incrementing a load dispatch count when the one or more elevator cars' current occupancy weight exceeds a threshold value; and (c) placing the one or more elevator cars into a load dispatch mode when the load dispatch count exceeds a load dispatch threshold for a common floor, wherein the load dispatch mode prioritizes an available elevator car of the one or more elevator cars to answer calls from the common floor.

11. An elevator controller for use with an elevator system having one or more elevator cars, wherein the elevator controller comprises:

(a) a first input comprising an electrical current measurement representing a load on a motor driving a select one of the one or more elevator cars within the elevator system;

(b) a second input comprising an occupancy weight threshold;

(c) an output comprising an estimated occupancy weight within the select one of the one or more elevator cars, wherein the estimated occupancy weight is determined from the electrical current measurement representing the load on the motor; and (d) wherein the elevator controller is configured to perform a first dependent action based upon the output comprising the estimated occupancy weight compared to the second input comprising the occupancy weight threshold, wherein the first dependent action comprises canceling one or more calls when the weight threshold value is not exceeded and indicates no passengers are present within the select one of the one or more elevator cars.

12. The elevator controller of claim 11, wherein a second dependent action comprises placing the elevator car into a load bypass mode when the weight threshold value is exceeded.

13. The elevator controller of claim 11, wherein a second dependent action comprises:

(a) tracking the one or more elevator cars originating from a common floor whose occupancy weight exceeds the occupancy weight threshold; and (b) directing the one or more elevator cars to service the common floor when a number of tracked elevator cars exceeds a count threshold value for the common origin floor.

* * * * *